United States Patent [19]

Schreiber

[11] Patent Number: 4,791,673

[45] Date of Patent: Dec. 13, 1988

[54] BONE CONDUCTION AUDIO LISTENING DEVICE AND METHOD

[76] Inventor: Simeon B. Schreiber, 1214 N. Belgrad Rd., Silver Spring, Md. 20902

[21] Appl. No.: 937,728

[22] Filed: Dec. 4, 1986

[51] Int. Cl.[4] ..... H04R 1/02; H04R 23/00

[52] U.S. Cl. ..... 381/151; 381/68.3; 381/188

[58] Field of Search ..... 381/151, 68, 68.3, 68.7, 381/69, 188, 205

[56] References Cited

U.S. PATENT DOCUMENTS

| | | | |
|---|---|---|---|
| Re. 31,031 | 9/1982 | Kissiah, Jr. | 381/68.3 |
| 466,725 | 1/1882 | Miltmore | 381/68.7 |
| 1,806,357 | 5/1931 | MacDonald | 381/68.3 |
| 2,151,706 | 3/1939 | Lieber | 381/68.3 |
| 2,230,500 | 1/1941 | Lybarger | 381/68.3 |
| 2,258,638 | 10/1941 | Zarth | 381/68.3 |
| 2,611,829 | 9/1952 | Hazard | 381/68.3 |
| 2,678,973 | 5/1954 | Newman | 381/151 |
| 3,868,572 | 2/1975 | Kaufman et al. | 325/16 |
| 3,869,584 | 3/1975 | Wilde | 381/68.3 |
| 3,894,196 | 7/1975 | Briskey | 381/68.6 |
| 3,985,977 | 11/1976 | Beaty | 455/66 |
| 4,025,734 | 5/1977 | Aloupis | 381/151 |
| 4,070,553 | 1/1978 | Hass | 381/151 |
| 4,237,449 | 12/1980 | Zibell | 381/68.2 |
| 4,322,585 | 3/1982 | Liautaud | 381/151 |
| 4,589,134 | 5/1986 | Waldron | 381/90 |
| 4,612,915 | 9/1986 | Hough et al. | 128/1 R |
| 4,654,883 | 3/1987 | Iwata | 381/151 |

FOREIGN PATENT DOCUMENTS

| | | | |
|---|---|---|---|
| 2451977 | 5/1975 | Fed. Rep. of Germany . | |
| 55-38733 | 3/1980 | Japan . | |
| 56-111396 | 9/1981 | Japan . | |
| 60-261296 | 12/1985 | Japan | 381/68.7 |
| 71090 | 10/1952 | Netherlands | 381/68.3 |
| 743722 | 1/1956 | United Kingdom . | |

OTHER PUBLICATIONS

Delta Airlines-*Flightline Gifts,* p. 23.

Abel, Kunov, Pichora-Fuller, & Alberti-"History, Hearing Loss & The Use of Ear Protection", 1985 *Scand. Audiol.,* 14, 161-173.

Catalano & Levin, "Noise Induced Hearing Loss and Portable Radios with Earphones", *International Journal of Pediatrics Otorhinolaryngology,* 9 (1985) 59-67.

Graupe, Grosspietsch & Taylor-"A self-adaptive noise filtering system", *Hearing Instruments,* vol. 37, No. 9, 1986, 29-34.

Katz et al., "Stereo Earphones and Hearing Loss", *New England Journal of Med.,* vol. 307, No. 23, 1982.

Lee, Senders, Gantz & Otto-"Transient Sensorineural Hearing Loss After Overuse of Portable Headphone Cassette Radios", *Otolaryngology, Head & Neck Surgery,* vol. 93, No. 5, Oct. 1985.

*Primary Examiner*—Jin F. Ng

*Assistant Examiner*—Danita R. Byrd

*Attorney, Agent, or Firm*—Saidman, Sterne, Kessler & Goldstein

[57] ABSTRACT

A bone conduction personal audio listening device and method is worn behind one or both ears in substantially close contact with the mastoid bone of the listener. The device is maintained on the listener's ear by hooking over the top of the ear, by hooking under the bottom of the ear, and by the contact with the mastoid bone. Due to placement of the device behind the listener's ear(s) ambient sounds of the local environment can be heard. Provision is also made for the listener through ear plug means to block out ambient sounds if so desired. The listener can remove and replace the waterproof audio speaker assembly of the device for cleaning purposes, or to change the color or reflectivity of the device for safety and/or cosmetic reasons.

21 Claims, 2 Drawing Sheets

BONE CONDUCTION AUDIO LISTENING DEVICE AND METHOD

BACKGROUND OF THE INVENTION

1. Field of the Invention

The present invention relates generally to personal audio listening devices which are worn by individual listeners and to methods related thereto. More particularly, the present invention is directed to a bone conduction audio listening systems and methods.

2. Related Art

Most conventional personal audio listening systems do not use bone conduction. Instead, such conventional systems provide sound to the listener in a normal air conduction fashion via the ear canal. These conventional personal sound systems have been marketed for use by listeners engaging in, among other things, outdoor activities such as jogging, hiking, skiing, and bicycling, and indoor activities such as housework, painting, and relaxing.

A well-known conventional sound system of this type includes a tape recorder/player or radio with a set of headphones or earphones connected by suitable wires to the radio or tape player. The headphones or earphones generate sound which is provided in an air conduction fashion to the listener by the ear canal(s). While such a system may provide high-quality audio for the listener, several serious disadvantages for the listener exist. Among these is the disadvantage of blocking ambient sounds in the local environment. Such ambient sound blockage may result in serious accidents for the listener due to the inability to hear local sounds.

Another serious disadvantage of this conventional personal audio listening system concerns the potential loss of hearing to the listener. Several medical studies specifically show that usage of such a conventional personal audio listening device leads to permanent hearing loss. See, for example, P. J. Catalano, S. M. Levin, "Noise-Induced Hearing Loss and Portable Radios with Headphones," *International Journal of Pediatrics Otorhinolgryngology,* 1985, p. 59 Tufts-New England Medical Center, "Stereo Earphones and Hearing Loss," *The New England Journal of Medicine,* Dec. 1982, Vol. 307, No. 23; and, P. C. Lee, M.D., C. W. Senders, M.D., "Transient Sensorineural Hearing Loss after Overuse of Portable Headphone Cassette Radios," *Otolaryangology, Head and Neck Surgery,* Vol. 93, No. 5, which references are incorporated by reference herein.

Other conventional personal audio listening systems are available which overcome some of the aforementioned safety and hearing loss problems by eliminating the headphones; however, they tend to be bulky, cumbersome, and uncomfortable to wear.

Examples of such conventional personal audio listening systems without headphones are shown in: U.S. Pat. No. 4,589,134 to Waldron for a sound system enclosed in a vest meant to be worn by the listener; U.S. Pat. No. 4,070,553 to Hass, for a scarf-tube enclosing a sound source meant to be worn around the listener's neck; U.S. Pat. No. 3,869,584 to Wilde, covering a device enclosing the ears of the individual listener; and U.S. Pat. No. 3,868,572 to Kaufman et al., representative of personal audio devices worn inside the ear of the individual listener. Yet another conventional personal audio system includes speakers adapted to clip onto a person's clothing, as shown in U.S. Pat. No. 4,322,585 to Liautaud.

Turning now to conventional bone conduction audio devices, they are typically hearing aids for the hearing impaired. Examples of such bone conduction hearing aids are found in: U.S. Pat. No. 2,230,500 to Lybarger; U.S. Pat. No. 2,258,638 to Zarth, West German Pat. No. 2451977 to Breckwoldt, and United Kingdom Pat. No. 743,722 to Patch. Most modern bone conduction hearing aid devices include the ability to implant the bone conduction oscillator beneath the listener's skin in direct contact with the mastoid bone. Such a device is shown in U.S. Pat. No. 4,612,915 to Hough et al.

The disadvantages of conventional bone conduction hearing aid devices generally include bulky and unsightly components designed to transmit a narrow band of audio frequencies, usually in the human voice range. Such narrow frequency range is unacceptable for musical listening purposes. Bone condition hearing aids are typically used in two circumstances: structural anomaly and chronic ear disease. If the ear is malformed or if there is no ear canal to channel air conductive sound, then the use of bone conduction is mandated. In addition, due to hearing impairment, such conventional bone conduction hearing aids must generate sounds at very high levels in order for the listener to be able to adequately "hear" by bone conduction action the sounds that are being emitted.

All bone oscillators rely on pressure to ensure good contact with the mastoid. Inadequate contact with the mastoid results in the hearing impaired listener from being unable to "hear" by bone conduction the sounds being emitted. This pressure needed for the required good mastoid contact may be achieved by mounting the oscillator on a headband, incorporating it in the temple portion of eye glasses, mounting it on the mastoid bone with tape, or designing some special system for maintaining mastoid contact. Such special contact includes both the subcutaneous attachment described in the U.S. Pat. No. 4,612,915 to Hough et al., noted above, and devices mounted within or on the teeth as shown in U.S. Pat. No. 3,985,977 to Beaty et al.

While these conventional systems, both bone conduction and air conduction, may function satisfactorily for their intended purposes, there is a need for a portable individual audio listening system which is comfortable and safe to use in a wide variety of activities that cannot be accommodated by the conventional systems. The inventor believes that the ability to hear ambient sounds is important to many listeners engaged in disparate activities. It is, of course, advantageous for joggers, runners, and cyclists to hear approaching traffic or warning signals for safety reasons. It is also advantageous to allow the individual listener to be able not only to listen to their local environment, but also to be in audio contact with remote communication centers, such as found in public utility work, military operations, and in the health care field.

Conventional audio listening systems have been developed which overcome the above-noted safety issues, but accomplish this at the expense of individual listener comfort. Other conventional audio listening systems have been developed that have addressed the comfort issue at the expense of listener hearing loss. In addition, none of these conventional devices utilize bone conduction methodology to provide high-quality audio, which is safe and easy to use, lightweight, waterproof, attractive, and comfortable.

SUMMARY OF THE INVENTION

The present invention is a type of bone conduction personal audio listening device and method which overcomes the problems of conventional personal audio listening systems.

The present invention is a bone conduction personal audio listening device and method wherein sound transmission from a separate audio signal source is connected by suitable wires to a bone conduction device that is attached to a listener's mastoid behind the ear(s) by operation of a curvilinear surface and a mastoid suction cup. Such placement of the bone conduction device also allows for open and unimpaired ambient sound transmission through the open ear of the listener. Three attachment areas are used to removably attach the device to the ear of the listener.

Provision is also made through suitable ear plug means to substantially block ambient sounds if the listener so desires.

Further, the present invention also allows the listener to remove the audio speaker assembly which may be of any suitable design, and replace it with another speaker assembly for purposes of cleaning, or to change the color and/or reflectivity of the personal audio listening device for safety and/or cosmetic reasons.

The present invention is a flexible, waterproof and lightweight bone conduction listening device, utilizing any of a number of materials such as rubber, flexible plastic, or other man made materials, such that mass production molding methods will allow for easy and cheap manufacture of the present invention.

BRIEF DESCRIPTION OF THE DRAWINGS

The foregoing and other objects, features an advantages of the present invention should become apparent from the following description when taken in conjunction with the accompanying drawings, in which.

DETAILED DESCRIPTION OF THE PREFERRED EMBODIMENT

Figure 1:
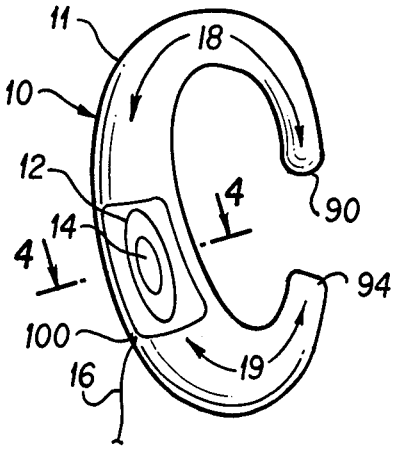
FIG. 1 is a top plan view of a permanently cemented waterproof speaker assembly 15 embodiment of device 10 of the present invention.

Referring first to FIG. 1, an embodiment of the bone conduction audio listening system of the present invention is shown. The bone conduction audio listening system comprises a device designated generally by a reference numeral 10. Device 10 includes a housing 11 having a small audio speaker 14 mounted behind a mastoid suction cup 12. Cup 12 can be molded in conjunction with the manufacture of the housing 11 of device 10. This embodiment can be made to be waterproof so that device 10 can be used in environmentally adverse situations. Note that in this embodiment, speaker 14 and mastoid suction cup 12 are permanently mounted to housing 11 of device 10. This embodiment can be made to be waterproof so that the device 10 can be used in environmentally adverse situations.

Figure 2:
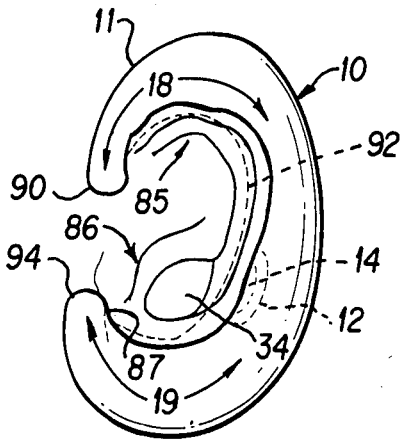
FIG. 2 is a perspective view of device 10 attached to the ear of a listener.

In the illustrated embodiment, housing 11 of device 10 is meant to slip over and attach to a listener's ear in a hanging fashion, as shown in FIG. 2. By hanging fashion, it is meant the three area removable attachment described immediately below. Specifically, the first area of attachment takes place by the cooperation of an upper attachment resulting from the hooking of a substantially curvilinear first surface 18 of housing 11 of device 10 around and over the top portion of the ear designated generally by reference numeral 85. Note that the first surface 18 is fashioned so that its first end portion 90 ends over the top of the ear and down towards the ear canal. Also understand that first surface 18 fits between the head and the back surface of the top portion 85 of the ear in the region where it hooks around the ear as indicated generally by the dash line 92. There should be no significant squeezing action on the top portion 85 of the ear produced by first surface 18 since such squeezing would result in listener discomfort both short and long term; instead, first surface 18 is removably attached by the hooking action produced by its substantially curvilinear shape in cooperation with the top portion 85 of the ear.

The second area of attachment takes place by the cooperation of a lower attachment resulting from the hooking of a substantially curvilinear second surface 19 of housing 11 of device 10 around and under the bottom portion (including the ear lobe 87) of the ear designated generally by reference numeral 86. Note that the second surface 19 is fashioned so that its second end portion 92 ends over the bottom of the ear and ear lobe 87 and extends upwardly toward the ear canal. Also understand that second surface 19 fits between the head and the back surface of the bottom portion 86 and the ear lobe 87 in the region where it hooks around the ears as indicated generally by the dash line 92. As is the case with first surface 19, there should be no significant squeezing action on the bottom portion 86 and the ear lobe 87 produced by the second surface 19 since such squeezing would result in listener discomfort both short and long term. Instead, second surface 19 is removably attached by the hooking action produced by its substantially curvilinear shape in cooperation with the bottom portion 86 and the ear lobe 87 of the ear.

Housing 11 as discussed below is fabricated of suitable material that can be shaped and bent during the fitting and/or attachment process, but which substantially maintains its shape during wearing by the listener. The action of the first surface 18 and the second surface 19 in cooperation with the ear results in housing 11 hanging on the ear with most of the weight of device 10 being applied to the ear at the top portion 85. Housing 11 and its contents can be arranged so as to result in a desired weight distribution balancing the weight of device 10 on the ear, which increases listener comfort and increases the desired retention of housing 11 to the ear. Note that "ballast" (not shown) can be added to housing 11 to improve this weight distribution.

As discussed above, first surface 18 and second surface 19 produce an upper hooking removable attachment and a lower hooking removable attachment with the ear so as to maintain housing 11 attached to the ear in any listener activity. This hooking action at the top and at the bottom of the ear prevents housing 11 from falling off the ear in an unwanted fashion when the listening activity produces significant motion, jarring or changes in orientation (such as running, aerobics or swimming). Since the shape of first surface 18 and second surface 19 as well as housing 11 are fashioned during the fitting process so that the ear is not substantially squeezed or distorted from its normal shape or from its normal projection from the head, the listener does not experience undesired short or long term discomfort.

The first and second areas of attachment act to retain housing 11 on the ear. They also act to position the mastoid suction cup 12 over the mastoid bone of the listener as discussed below, This positioning can be adjusted during the fitting process by the fitter in changing the shape and curve of first surface 18 and second surface 19.

The third attachment area is produced by the suction attachment to the area over the mastoid of the listener produced by the mastoid suction cup 12. As shown generally in FIG. 2, this attachment acts to maintain substantially close contact between device 10 and the listener's mastoid bone behind the ear. As stated above, the position of suction cup 12 can be changed in the fitting process by adjusting the shape and curve of first surface 18 and second surface 19.

Figure 4:
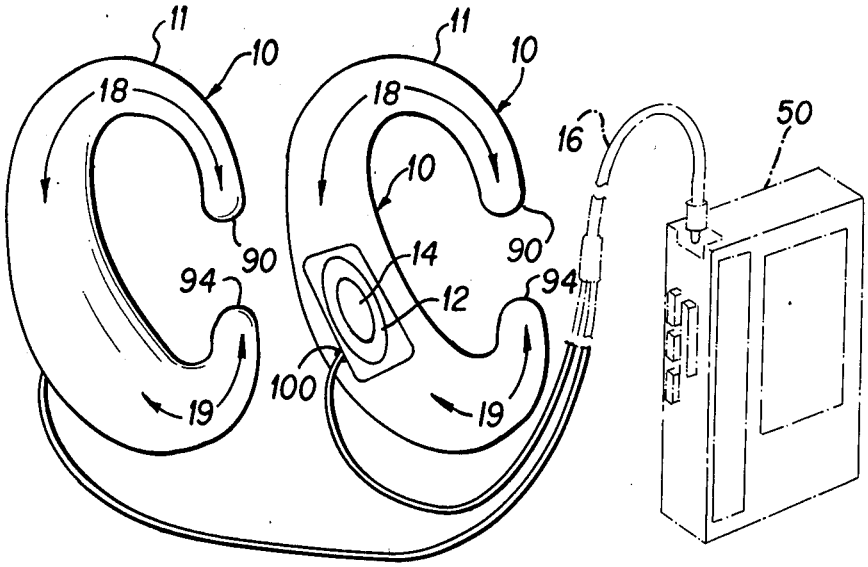
FIG. 4 is a perspective view of an embodiment of the present invention having two devices 10 connected to a signal source 50 to provide stereophonic listening to the listener.

The device 10, as shown in FIG. 1, further includes a flexible connecting cable 16 of at least two wires appropriately connected to the speaker 14 on one end and to a suitable signal producing unit 50, shown in dashed line in FIG. 4, at the other end.

Housing 11 of device 10 may be fabricated from any of a number of conventional substantially flexible and lightweight materials. Examples of suitable materials include molded rubber, and synthetic materials of numerous kinds, such as silicone plastics and vinyls. The fabrication material must be flexible enough so that the shape of housing 11 can be suitably modified during the fitting and/or attachment process so that it can be taken on and off the listener's ear(s) with ease. However, the material must be able to provide sufficient rigidity to support speaker 14 when the listener is wearing device 10.

The material used for mastoid suction cup 12 must be able to produce the needed suction action with the area of the listener's neck above the mastoid bone throughout a variety of temperature and humidity ranges encountered during normal operation. This suction action is needed for two reasons. The first reason is that it is needed for proper sound transmission between the speaker 14 and the mastoid bone of the listener. The second reason is that the suction is needed to produce the third attachment area of device 10 to the head of the listener. This three point attachment is needed to maintain positioning and proper orientation of device 10 with respect to the ear and to the head of the listener during normal use (such as jogging, aerobics and running, etc.). Note that any suitable color and reflectivity for the materials for housing 11 and suction cup 14 can be used for safety and visibility reasons and/or in order to suit an individual listener's taste or wardrobe requirements.

Figure 3:
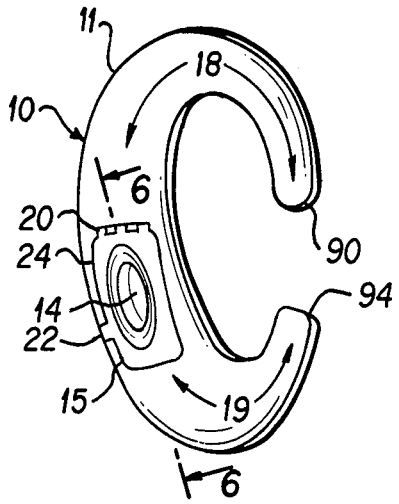
FIG. 3 is a perspective view of the removable speaker assembly 15 embodiment of the present invention.

An embodiment of the present invention which permits the removal of speaker 14 so as to allow for cleaning of the device 10 or interchanging the audio speaker 14 with device 10 of another color, reflectivity and/or material is shown in FIG. 3. For example, a speaker assembly 15 may include a speaker retainer 24 attached to device 10 by a hinge area 20, of any suitable design, and is also attached at its other end by a thumbnail catch 22 of any suitable design. Such an embodiment of the present invention allows audio speaker 14 to be interchangeably removed from device 10. Note that any suitable arrangement can be employed to achieve this interchangeability.

Figure 5:
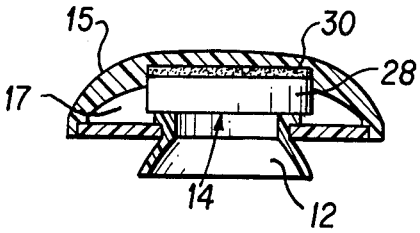
FIG. 5 is a cross-sectional view of an assembled device 10 taken along line 4—4 of FIG. 1.
Figure 5A:
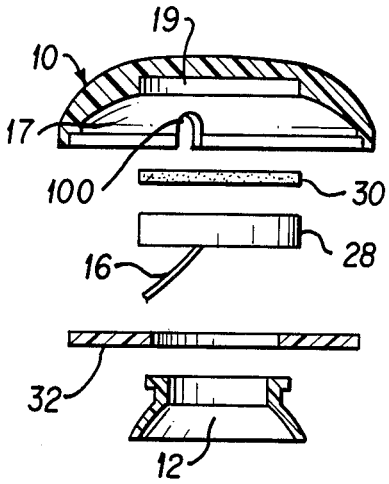
FIG. 5*a*. is a disassembled view of the device 10 of FIG. 5.
Figure 6:
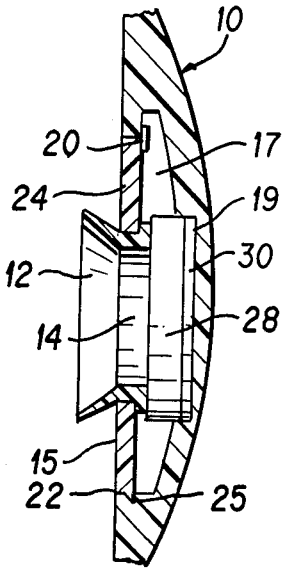
FIG. 6 is a cross-sectional view of the removable speaker assembly 15 embodiment taken along line 6—6 of FIG. 3.

An example of the embodiment of the permanently mounted waterproof embodiment of device 10 of FIG. 1 is shown in assembled form in FIG. 5. FIG. 5A shows the embodiment of FIG. 5 in disassembled form. The three point attachment of device 10 of the ear and head of the listener does not require any attachment material or cement. Consequently, as long as suction cup 12 can maintain the needed suction, device 10 can be used in any wet environment. In fact, it is contemplated that the present invention can be used underwater.

Referring now to FIGS. 5 and 5A, speaker 14 having a bone oscillator 28 is held in a press fit arrangement in a cavity 17 of device 10 by the mastoid suction cup 12 and an attached piece 32. Note that a waterproof gasket 30 is disposed between a formed area 19 of cavity 17 and the back surface of bone oscillator 28. As shown in FIG. 5A, flexible connecting cable 16 connected to bone oscillator 28 exits cavity 17 via a connection way 100 molded into cavity 17. Waterproof gasket 30 prevents water and other unwanted fluids from leaking into cavity 17. Such leakage would impair the performance of bone oscillator 28. Attachment piece 32 can be press fitted and/or cemented to device 10 using any suitable means.

Figure 7:
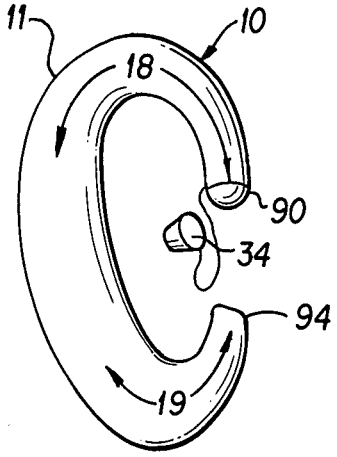
FIG. 7 is a perspective view of an embodiment of the present invention having device 10 attached to the ear of the listener and a plug 34 inserted into the ear canal of the ear.

In another embodiment of the present invention as shown in FIG. 7, an ear plug 34 is inserted into the ear canal of the listener's ear to which is attached the device 10. Note that ear plug 34 preferably is attached by a tether (string or the like) to curvilinear first surface 18 of device 10. Ear plug 34 acts to substantially reduce or block out all ambient sounds. This sound reduction and/or elimination allows the listener to choose either single sound source listening or to substantially reduce or block out potentially harmful sound sources in the ambient environment. Ear plug 34 can be made of any suitable material which provides the necessary sound reduction with the physical characteristics needed for wearing by the listener.

Device 10 is removably attached to the ear and head of the listener substantially according to the following method. First, housing 11 is shaped and bent during the fitting process as described above. Second during attachment the listener preferably slides first surface 18 behind the portion 85 while sliding the first end 90 over the head and adjacent the upper portion 85. This establishes the first area of attachment and allows device 10 to hang off the ear so that the listener can concentrate on establishing the second attachment area. (Note that the listener can attach and remove device 10 from the ear under this procedure using only one hand.)

Third, the listener then inserts his thumb behind the ear lobe while holding the second portion 19 of housing 11 against the outer surface lower portion 86 with his first and/or second fingers. The second attachment is established by using the thumb to push ear lobe 87 next to second portion 19 and then over second portion 19 so that the ear lobe 87 and lower portion 86 of the ear are now on the other side of housing 11. In other words, housing 11 is not placed entirely behind the listener's ear except for the first end 90 and the second end 94.

Fourth, the third attachment area 15 established by the user first moving the suction cup 12 over the mastoid bone, and then pushing housing 11 toward the head. This creates the needed suction between suction cup 12 and the head of the listener. This completes the removable attachment process. Removal of device 10 proceeds substantially in reverse of the steps outlined above.

The bone conduction audio listening system of the present invention can be utilized in a number of different ways. Because the speakers 14 of the devices 10 transmit sound vibrations substantially via the mastoid bone, ambient background noise can still be heard by the listener. Hence, the listener is able to hear approaching vehicles, traffic noise, and other environmental sounds, such as verbal commands or warnings, depending on the situation at hand. Each method of utilization therefore utilizes the binaural aspect of the present invention: the ambient listening channel and the listening channel provided by the device 10. The binaural aspect of the present invention results in greater safety and increased flexibility to the listener.

For example, the present invention may be used by a runner or jogger who in the interest of safety needs to hear approaching traffic. In addition, the device 10 could be used as an intercom arrangement by medical professionals, military personnel, or utility workers who need to hear sounds in their local environment as well as being in continuous contact with a separate communications source (not shown). Also, various occupations require the ability to listen to two sound sources simultaneously, such environment exist in many office places. Given the binaural aspect of the present invention, the device 10 could also be utilized with earplug(s) 34 to block out all ambient noise for the various reasons discussed above.

The present invention is a general-purpose, monophonic or stereophonic headphone of advanced design, which can provide a binaural listening capacity. It is an improved individual listening device that is attractive, waterproof, and easy to attach, wear, and remove. Due to the design of incorporating bone conduction methodology, potential trauma leading to hearing loss of the individual listener by utilizing conventional audio devices over or in the listener's ear(s) is eliminated.

While preferred embodiments have been set forth, various modifications, alterations, and changes may be made without departing from the spirit and scope of the present invention as defined in the appended claims.

I claim:

1. A listening device adapted to be removably mounted to a listener's ear so as not to exclude ambient sounds received through an ear canal of the listener's ear, which comprises:

(a) a housing shaped substantially in the form of a C comprising:
  (i) a first portion with a first end integral to said housing adapted to establish a first attachment area to said listener's ear; and
  (ii) a second portion with a second end integral to said housing adapted to establish a second attachment area to said listener's ear; and (b) speaker means mounted in said housing, which comprises:
  (i) a speaker assembly having bone conduction means for emitting audible sounds, said speaker assembly disposed so as to be substantially over a mastoid bone of said listener when said housing is mounted to said listener's ear according to said first and second attachment areas; and
  (ii) suction cup means attached to said speaker assembly for establishing a third attachment area to the head of said listener by a suction action and for transmitting said audible sounds from said bone conduction means through said suction cup means to said mastoid bone of said listener, whereby said listening device transmits said available sounds by bone conducting so as not to exclude ambient sounds received through said ear canal of said listener's ear.

2. The listening device according to claim 1, wherein said housing is made of relatively flexible synthetic material.

3. The listening device of claim 1, wherein said housing substantially reflects incoherent light.

4. The listening device of claim 3, wherein said housing is colored.

5. The listening device of claim 1, wherein said housing is waterproof.

6. The listening device of claim 1, wherein said speaker means comprises mastoid bone oscillator means.

7. The listening device of claim 1, wherein said speaker means is permanently affixed to said housing.

8. The listening device of claim 1, wherein said speaker means is waterproof.

9. The listening device of claim 1, wherein said speaker means is removably attached to said housing.

10. A listening device adapted to be removably mounted to a listener's ear to exclude ambient sounds received through an ear canal of the listener's ear, which comprises (a) a housing shaped substantially in the form of a C, said housing comprising:
  (i) a first portion with a first end integral to said housing adapted to establish a first attachment area to said listener's ear; and
  (ii) a second portion with a second end integral to said housing adapted to establish a second attachment area to said listener's ear; and (b) ambient sound blocking means adapted to be removably attached to said housing and worn in said ear canal of said listener's ear; and (c) speaker means mounted in said housing, said speaker means comprising:
  (i) a speaker assembly having bone conduction means for emitting audible sounds, said speaker assembly disposed substantially over a mastoid bone of said listener when the housing is mounted to said listener's ear according to said first and second attachment areas; and
  (ii) suction cup means attached to said speaker assembly for establishing a third attachment area to the head of said listener by a suction action and for transmitting said audible sounds from said bone conduction means to the mastoid bone of the listener.

11. The listening device of claim 10, wherein said ambient sound blocking means comprises earplug means.

12. The listening device of claim 10, wherein said housing substantially reflects incoherent light.

13. The listening device of claim 12, wherein said housing is colored.

14. The listening device of claim 10, wherein said housing is comprised of substantially flexible synthetic material.

15. The listening device of claim 10, wherein said housing is waterproof.

16. The listening device of claim 10, wherein said speaker means is permanently affixed to said housing.

17. The listening device of claim 10, wherein said speaker means is removably attached to said housing.

18. The listening device of claim 10, wherein said speaker means is waterproof.

19. A bone conduction personal audio listening method for transmitting sounds to a listener's ear so as not to exclude ambient sounds received through an ear canal of the listener's ear, which method comprises the steps of:

attaching a housing comprising sound transmission means to a listener's head, by:

attaching said sound transmission means to said listener's ear at a first attachment area;

attaching said sound transmission means to said listener's ear at a second attachment area;

attaching said sound transmission means by suction to a third attachment area over a mastoid bone of said listener's ear; and transmitting audible sounds through said third area of attachment to said mastoid bone of said listener, whereby said listening device transmits said audible sounds by bone conduction so as not to exclude ambient sounds received through said ear canal of said listener's ear.

20. The listening device of claim 1 wherein said suction cup means is disposed within said housing so as to establish said third attachment area over said mastoid bone of said listener when said listening device is mounted to said listener's ear.

21. The listening device of claim 20 wherein said suction cup means is juxtaposed to said speaker assembly, whereby sounds from said bone conduction means will pass through said suction cup means to said mastoid bone of said listener.

* * * * *

UNITED STATES PATENT AND TRADEMARK OFFICE

CERTIFICATE OF CORRECTION

PATENT NO. : 4,791,673
DATED : December 13, 1988
INVENTOR(S) : Simeon B. Schreiber It is certified that error appears in the above—identified patent and that said Letters Patent is hereby corrected as shown below:

COLUMN 8

Line 16, "available" should read --audible--;

Line 16, "conducting should read --conduction--.

Signed and Sealed this

Twenty-third Day of May, 1989

*Attest:*

DONALD J. QUIGG

*Attesting Officer*

*Commissioner of Patents and Trademarks*